US006033832A

United States Patent [19]

Wingender

[11] Patent Number: 6,033,832

[45] **Date of Patent: *Mar. 7, 2000**

[54] PROCESS FOR THE PRODUCTION OF A PHOTOGRAPHIC IMAGE

[75] Inventor: Kaspar Wingender, Leverkusen, Germany

[73] Assignee: Agfa-Gevaert N.V., Mortsel, Belgium

[ * ] Notice: This patent is subject to a terminal disclaimer.

[21] Appl. No.: 07/916,899

[22] Filed: Jul. 20, 1992

[30] Foreign Application Priority Data

Aug. 3, 1991 [DE] Germany ..... 41 25 756

[51] Int. Cl.[7] ..... G03C 5/00; G03C 5/29

[52] U.S. Cl. ..... 430/373; 430/10; 430/376; 430/357; 430/944

[58] Field of Search ..... 430/10, 22, 373, 430/363, 376, 364, 352, 943, 944, 357; 283/77

[56] References Cited

U.S. PATENT DOCUMENTS

| | | | |
|---|---|---|---|
| 3,819,372 | 6/1974 | Newman et al. | 430/364 |
| 4,094,682 | 6/1978 | Fujiwhara et al. | 430/373 |
| 4,113,490 | 9/1978 | Fujiwhara et al. | 430/373 |
| 4,200,466 | 4/1980 | Fujiwhara et al. | 430/552 |
| 4,203,767 | 5/1980 | Fujiwhara et al. | 430/376 |
| 4,216,285 | 8/1980 | Miller | 430/364 |
| 4,219,615 | 8/1980 | Sakai | 430/373 |
| 4,222,777 | 9/1980 | Nakajima et al. | 430/363 |
| 4,414,305 | 11/1983 | Nakamura et al. | 430/373 |
| 4,529,687 | 7/1985 | Hirai et al. | 430/373 |
| 4,816,378 | 3/1989 | Power et al. | 430/363 |
| 4,954,425 | 9/1990 | Iwano | 430/373 |
| 5,200,301 | 4/1993 | Wingender et al. | 430/364 |

FOREIGN PATENT DOCUMENTS 0 342 601 5/1989 European Pat. Off. .

*Primary Examiner*—Martin J. Angebranndt
*Attorney, Agent, or Firm*—Connolly Bove Lodge & Hutz LLP

[57] ABSTRACT

A process for the production of a photographic image, in particular an ID card, using a color photographic silver halide material on a reflective support having a zone I in which information is recorded in the form of a colored image and a zone II in which data readable by infra-red light are recorded, comprising the following processing steps:

a) exposure, b) development with a color developer, c) treatment with $H_2O_2$ or a compound releasing $H_2O_2$, d) fixing without prior or concomitant bleaching, e) washing or stabilizing and f) drying, in which steps (b) and (c) may be combined to a single step, results in a clear color image as well as a silver image which is reliably legible under IR light if steps (a) and (b) are carried out in such a manner that the silver maximum density in zone II after processing is at least 0.35, preferably not less than 0.5, measured under reflection at 850 nm, and the silver maximum density in zone I after processing is at most 0.5 in areas having a neutral color density of not more than 1.5 and at most 0.4 in areas having a yellow, magenta or cyan color separation density of not more than 1.5, measured under reflection at 850 nm.

5 Claims, No Drawings

PROCESS FOR THE PRODUCTION OF A PHOTOGRAPHIC IMAGE

Process for the production of a photographic image ID Cards carrying an information readable by machine in addition to a picture of the owner of the card are becoming increasingly more common in use. The trend is towards colored portraits of the card holder produced by a conventional color photographic process. This process is based on a color photographic silver halide material which is exposed and developed and comprises a stage of silver removal consisting of bleaching and fixing in which all the silver and silver halide are removed and the clear color image produced from color couplers present in the material and the oxidation product of p-phenylenediamine developer comes into view. Machine readable information, which is usually information readable by infra-red light, cannot be produced by this method since the dyes produced have only a very low IR (infrared) absorption and the silver, which has sufficient IR absorption, has obviously been removed.

According to EP-A-0 342 601, this difficulty is to be overcome by removing only part of the silver in spite of the whole ID card being bleached, in the hope that more silver will be produced in the data area, a part of which silver will be left behind when sufficient silver has been removed from the color image; or the problem may be solved by exposing only part of the ID card to the bleaching agent and keeping the part which carries the IR readable information free from the bleaching agent or its effect. Both methods have so many uncertainty factors that they are virtually unusable in practice since in the former case too much silver is liable to be removed from the data area or the color image is liable to be unclear and unsightly due to insufficient removal of silver whereas in the latter case a clear separation between the image part which is to be bleached and the image part which is to be left unbleached can only be achieved by very elaborate precautions.

It was therefore an object of the present invention to provide a process for the production of an ID card in which, starting from a color photographic silver halide material, a clear color image can easily be obtained while an IR-readable silver image is produced in another part of the card.

This problem is solved by means of a so-called development reinforcing process in which a color image is first produced by development and the silver image which is produced at the same time is superimposed on this color image. In the reinforcing stage with $H_2O_2$, only the color image is reinforced in the areas still containing as yet unreacted color coupler, depending on the silver produced, but the silver image is not reinforced. The color gradation is thereby differentiated from the silver gradation. As a result, the region of maximum colour density is superimposed on the increasing silver density.

This invention therefore relates to a process for the production of a photographic image, in particular an ID card, using a color photographic silver halide material on a reflective support comprising a zone I carrying information in the form of a color image and a zone II in which data readable by infra-red light are recorded, comprising the following processing steps:

(a) exposure,
(b) development with a color developer,
(c) treatment with $H_2O_2$ or a compound releasing $H_2O_2$,
(d) fixing without prior or concomitant bleaching,
(e) washing or stabilization and
(f) drying, in which steps (b) and (c) may be combined to a single step, characterised in that steps (a) and (b) are carried out in such a manner that the silver maximum density in zone II is at least 0.35,preferably not less than 0.5, after processing, determined under reflection at 850 nm, and the silver maximum density in zone I after processing is at most 0.5 in areas having a neutral color density of at most 1.5, and is at most 0.4 in areas having a yellow, magenta or cyan color separation density of at most 1.5, measured under reflection at 850 nm.

In a preferred embodiment, the data in the IR-readable zone are exposed to light of greater intensity than the data of the colored zone.

The zones I and II may be spatially separated from one another.

The photographic material used may in particular be a material having at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler, these layers being mounted on a support, in particular a reflective support, and the silver halides of these layers containing at least 97 mol-% of silver chloride and at most 3 mol-% of AgBr while the amount of silver halide applied, measured in terms of $AgNO_3$, amounts to more than 0.6 g/m$^2$, in particular from 0.75 to 1.5 g/m$^2$, and the layer or layers of each color sensitivity has or have a total silver halide application of at least 0.12 g/m$^2$, measured in terms of $AgNO_3$.

The silver halide emulsions are preferably negatively operating emulsions.

In addition to the silver halide layers containing the yellow, magenta and cyan couplers, the photographic material may contain another silver halide layer which is free from couplers and only produces a silver image which is readable by IR light.

In addition to the light-sensitive layers, the material may contain light-insensitive layers, so-called auxiliary layers. The number and sequence of these layers depend on the quality requirements to be met by the material. The yellow, magenta and cyan couplers are the compounds conventionally used in photography.

The light-sensitive material may also contain the following auxiliary agents: Antifoggants, hardeners, plasticizers, polymeric latices, UV (ultraviolet) absorbents, formalin acceptors, mordants, development accelerators, white toners, matting agents, lubricants, antistatic agents, wetting agents and similar compounds. The light-sensitive material may be exposed in known manner. For example, the following sources of light may be used for exposure: Tungsten, halogen, xenon and mercury lamps, CRT (Cathode Ray Tube) tubes, LED (light emitting diode) and FOT (Fiber Optic Cathode Ray Tube).

The color of the source of exposure may be adjusted with color filters so that an image which is neutral in color is obtained.

It is particularly suitable to use an exposure device in which the original to be exposed is measured out in the form of a large number of image dots and the measuring signals are digitalized, processed and stored and used again for exposure by means of CRT.

The exposed and processed material may be directly used as ID card but an identification card is more commonly laminated with a transparent film on one or both sides. Such a unit is particularly scratch-resistant, stable and protected against falsification and alteration.

A suitable material for such a laminate consists of a plastic or paper and a heat sealing layer. At least part of the ID card produced as described above must be capable of absorbing IR (infrared) light in a region above 750 nm or more, preferably at 850 to 950 nm. It may be readable by transmitted light or by reflected light, provided only that the sensitivity of the reading instrument is adjusted to the properties of the material.

The marks readable by infra-red light may be BAR code or OCR Optical Character Reading code marks.

EXAMPLE

A color photographic recording material was produced by applying the following layers in the given sequence to a layer support of paper coated with polyethylene on both sides. The quantities given are based in each case on 1 $m^2$. The silver halide applied is given in terms of the corresponding quantities of $AgNO_3$.

Layer arrangement 1

1st Layer (substrate layer):

0.2 g of gelatine

2nd Layer (blue-sensitive layer):

Blue-sensitive silver halide emulsion (99.5 mol-% chloride, 0.5 mol-% bromide, average grain diameter 0.8 $\mu$m) obtained from 0.4 g of $AgNO_3$ with 1.04 g of gelatine 0.60 g of yellow coupler GB 1

0.01 g of white coupler WK 1 and 0.40 g of tricresyl phosphate (TCP)

3rd Layer (protective layer):

1.1 g of gelatine 0.2 g of 2,5-dioctylhydroquinone 0.2 g of dibutylphthalate (DBP)

4th Layer (green sensitive layer)

green sensitized silver halide emulsion (100 mol-% chloride, average grain diameter 0.4 $\mu$m) obtained from 0.38 g of $AgNO_3$ with 1.05 g of gelatine 0.40 g of magenta coupler PP 1

0.06 g of 2,5-dioctylhydroquinone 0.45 g of DBP 0.40 g of TCP

5th Layer (UV protective layer)

1.30 g of gelatine 0.60 g of UV absorbent UV 1

0.10 g of 2,5-dioctylhydroquinone 0.35 g of TCP

6th Layer (red-sensitive layer)

red-sensitized silver halide emulsion (100 mol-% chloride, average grain diameter 0.35 $\mu$m) obtained from 0.28 g of $AgNO_3$ with 0.72 g of gelatine 0.36 g of cyan coupler BG 1 and 0.36 g of TCP 7th Layer (UV protective layer)

0.35 g of gelatine 0.15 g of UV absorbent UV 1

0.075 g of TCP

8th Layer (protective layer)

0.9 g of gelatine 0.3 g of hardener H 1

GB1

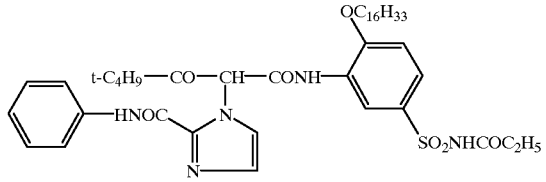

PP1

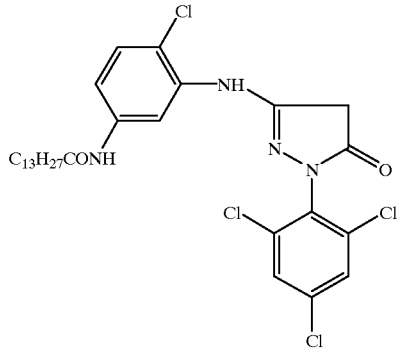

BG1

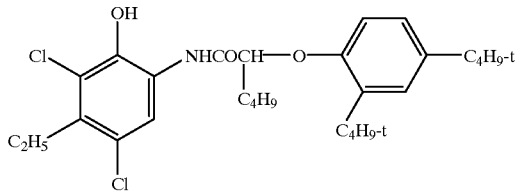

UV1

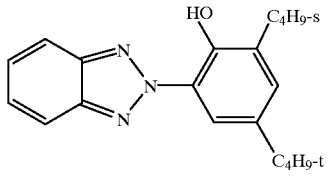

H1

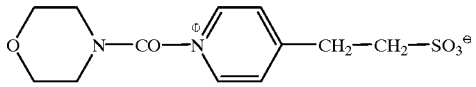

WK1

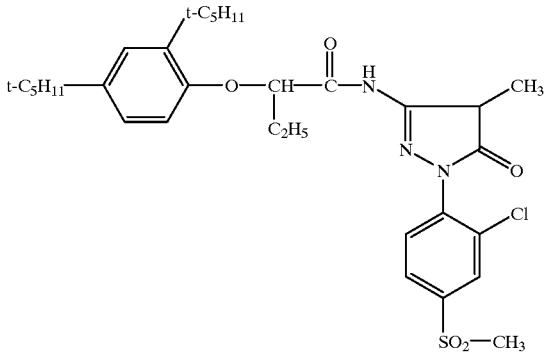

The layers were dried, exposed imagewise in a sensitometer through a step wedge with 120 Lx.s behind grey, blue, green and red filters and developed as follows:

| | | |
|---|---|---|
| Color development | 35° C. | 25 s |
| Reinforcement | 23° C. | 10 s |
| Fixing | 23° C. | 15 s |
| Washing | 23° C. | 60 s |

Composition of the color developer solution

| | |
|---|---|
| Water | 800 ml |
| Polyglycol P400 | 22 ml |
| Diethyl-hydroxylamine (85% by wt., aqueous) | 6 ml |
| CD3 (color developer 3; N-ethyl-N-β-methanesulfonamidoethyl-3-methyl-4-aminoanilinesulfate) | 7.2 g |
| Potassium sulphite | 0.33 g |
| 1-Hydroxyethane-1,1-diphosphonic acid | 0.14 g |
| Potassium bicarbonate | 5.0 g |
| Potassium carbonate | 22.0 g |
| Potassium hydroxide about | 3.5 g |
| Dodecylbenzene sulphonate | 0.02 g |
| Methylbenzotriazole | 0.005 g |
| White toner | 2.3 g |
| made up with water to 1000 ml | pH 10.6 |

Composition of the reinforcing bath

| | |
|---|---|
| Water | 990 ml |
| Aqueous hydrogen peroxide solution (35% by weight) | 10 ml |

Composition of the fixing solution

| | |
|---|---|
| Water | 800 ml |
| Ammonium thiosulphate | 50 g |
| Sodium sulphite | 5 g |
| Sodium hydrogen sulphite | 2 g |
| made up with water to 1000 ml | pH 10.6 |

EXAMPLE 2 (COMPARISON)

The material of Example 1 was processed as follows:

| | | |
|---|---|---|
| Color development | 35° C. | 25 s |
| Fixing | 23° C. | 15 s |
| Washing | 23° C. | 60 s |

EXAMPLE 3 (COMPARISON)

The material of Example 1 was processed as follows:

| | | |
|---|---|---|
| Color development | 35° C. | 25 s |
| Reinforcement | 23° C. | 10 s |
| Bleach fixing | 30° C. | 25 s |
| Washing | 23° C. | 90 s |

Composition of the bleach fixing bath

| | |
|---|---|
| Water | 800 ml |
| Ammonium-iron(III)-EDTA | 45 g |
| Sodium sulphite | 10 g |
| Ammonium thiosulphate | 80 g |
| made up with water to 1000 ml | pH 6.0 |

The grey scale and the yellow, magenta and cyan separation of the processed and dried samples were measured behind blue, green, red and infra-red filters (850 nm). The results are shown in Tables 1–3.

The results of the measurements show that the proportion of silver density, measured as IR density, in the image areas required for a portrait, is considerably lower in Example 1 according to the invention up to a density of 1.5 than in Example 2 which was produced without color reinforcement.

A comparison of Tables 1 and 3 shows that the grey density which was due to the remnants of developed silver in an image produced with color reinforcement is within the order of magnitude of the side density produced by the given dyes, measured behind a filter which is not in the complementary color.

A comparison of Tables 1 and 3 also shows that a color image produced photochemically and bleached and fixed by the traditional method has no measurable density in the IR range.

Table 1 to Example 1

| Color field | Measuring filter | Dmax | % side density at D = 1.0 | % side density at D = 1.5 | Dmin |
|---|---|---|---|---|---|
| Yellow | b | 2.08 | — | — | |
| | g | 0.94 | 37 | 32 | |
| | r | 0.49 | 16 | 16 | |
| | ir | 0.48 | 16 | 15 | |
| Magenta | b | 1.65 | 42 | 41 | |
| | g | 2.55 | — | — | |
| | r | 1.23 | 28 | 26 | |
| | ir | 0.83 | 17 | 14 | |
| Cyan | b | 1.00 | 30 | 27 | |
| | g | 1.45 | 46 | 38 | |
| | r | 2.53 | — | — | |
| | ir | 0.73 | 17 | 15 | |
| Grey | b | 2.25 | — | — | 0.127 |
| | g | 2.40 | — | — | 0.151 |
| | r | 2.45 | — | — | 0.111 |
| | ir | 1.40 | 32 | 31 | 0.100 |

Table 2 to Example 2

| Color field | Measuring filter | Dmax | % side density at D = 1.0 | % side density at D = 1.5 | Dmin |
|---|---|---|---|---|---|
| Yellow | b | 2.03 | — | — | |
| | g | 0.72 | 41 | 37 | |
| | r | 0.48 | 32 | 27 | |
| | ir | 0.48 | 26 | 25 | |
| Magenta | b | 1.23 | 58 | 51 | |
| | g | 2.41 | — | — | |
| | r | 1.00 | 46 | 40 | |
| | ir | 0.92 | 46 | 40 | |
| Cyan | b | 0.88 | 43 | 39 | |
| | g | 1.02 | 48 | 45 | |
| | r | 2.46 | — | — | |
| | ir | 0.76 | 38 | 33 | |
| Grey | b | 2.15 | — | — | 0.114 |
| | g | 2.32 | — | — | 0.146 |
| | r | 2.38 | — | — | 0.111 |
| | ir | 1.45 | 55 | 50 | 0.100 |

Table 3 to Example 3

| Color field | Measuring filter | Dmax | % side density at D = 1.0 | % side density at D = 1.5 | Dmin |
|---|---|---|---|---|---|
| Yellow | b | 1.98 | — | — | |
| | g | 0.75 | 32 | 29 | |
| | r | 0.27 | 12 | 10 | |
| | ir | 0.10 | 9 | 7 | |
| Magenta | b | 1.37 | 43 | 41 | |
| | g | 2.03 | — | — | |
| | r | 0.95 | 27 | 25 | |
| | ir | 0.13 | 10 | 7 | |
| Cyan | b | 0.73 | 30 | 27 | |
| | g | 1.14 | 39 | 36 | |
| | r | 2.53 | — | — | |
| | ir | 0.15 | 11 | 10 | |
| Grey | b | 2.15 | — | — | 0.125 |
| | g | 2.39 | — | — | 0.148 |
| | r | 2.42 | — | — | 0.106 |
| | ir | 0.14 | 5 | 5 | 0.07 |

A "—" in the column "% side density" means main color density (set at 100%).

I claim:

1. A process for the production of an ID- card, using a color photographic silver halide material having at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler on a reflective support comprising a zone I in which information is recorded in the form of a colored image and a zone II in which data readable by infra-red light are recorded, comprising the following processing steps:

(a) exposure, (b) development with a color developer, (c) treatment with $H_2O_2$ or a compound releasing $H_2O_2$, (d) fixing without prior or concomitant bleaching, (e) washing or stabilizing and (f) drying, in which steps (b) and (c) may be combined to a single step, characterized in that steps (a) and (b) are carried out in such a manner that the silver maximum density in zone II after processing is at least 0.35 measured under reflection at 850 nm, and the silver maximum density in zone I, after processing is at most 0.5 in areas having a neutral color density of at most 1.5, and is at most 0.4 in areas having a yellow, magenta or cyan color separation density of at most 1.5, measured under reflection at 850 nm.

2. A process according to claim 1, characterised in that the color photographic material contains negatively operating silver halide emulsions.

3. A process according to claim 1, characterised in that the color photographic material contains silver halide emulsions comprising at least 97 mol-% AgCl and at most 3 mol-% AgBr.

4. A process according to claim 1, characterized in that the color photographic material has total silver application, measured in terms of $AgNO_3$, of from 0.6 to 1.5 g/m$^2$ in the light sensitive areas, the layer or layers of each color sensitivity having a total silver halide application of at least 0.12 g/m$^2$, stated in terms of $AgNO_3$.

5. A process according to claim 1, characterized in that the silver maximum density in zone II after processing is not less than 0.5.

* * * * *